United States Patent [19]

Bond

[11] Patent Number: 4,977,836

[45] Date of Patent: Dec. 18, 1990

[54] PARTS STACKING PALLET

[76] Inventor: Irvin D. Bond, 1027 Allen Rd., Clarkston, Mich. 48016

[21] Appl. No.: 483,753

[22] Filed: Feb. 23, 1990

Related U.S. Application Data

[63] Continuation-in-part of Ser. No. 227,099, Aug. 1, 1988, Pat. No. 4,915,033.

[51] Int. Cl.[5] ..... B65D 19/44

[52] U.S. Cl. ..... 108/55.1; 248/396; 411/85

[58] Field of Search ..... 108/55.1, 55.3, 55.5, 108/54.1; 248/346, 558, 678, 680; 411/84, 85

[56] References Cited

U.S. PATENT DOCUMENTS

| | | | |
|---|---|---|---|
| 1,963,242 | 6/1934 | Nelson | 248/346 X |
| 2,539,809 | 1/1951 | Nelson | 248/346 |
| 2,828,931 | 4/1958 | Harvey | 108/54.1 |
| 3,456,706 | 7/1969 | Ollis, Jr. | 411/84 X |
| 3,877,671 | 4/1975 | Underwood et al. | 248/346 |
| 4,212,446 | 7/1980 | Domanick et al. | 248/346 X |
| 4,393,999 | 7/1983 | Forshee | 248/346 |
| 4,915,033 | 4/1990 | Bond | 108/55.1 |

*Primary Examiner*—Peter A. Aschenbrenner
*Attorney, Agent, or Firm*—Charles W. Chandler

[57] ABSTRACT

A pallet for supporting a plurality of similarly shaped parts piled one above another in a stacked relationship. Locator pins on a base portion of the pallet keep the parts in the desired stacked condition. The pallet base includes two parallel horizontal tubes that are adapted to receive the prongs of a fork lift truck for transporting the pallet. Structural beam elements are welded to the prong-receiving tubes to provide a high-strength base structure. The locator pins are detachably connected with anchoring blocks that can be slidably adjusted in (along) hollow tracks affixed to the base area of the pallet. Each anchoring block has threaded engagement with a socket member, such that when a locator pin is inserted into a socket member and turned around the pin axis, the anchoring block is automatically clamped against interior surfaces of the associated track.

13 Claims, 4 Drawing Sheets

PARTS STACKING PALLET

CROSS-REFERENCE TO RELATED PATENT APPLICATION

This is a continuation-in-part of my co-pending U.S. patent application Ser. No. 227,099, filed on Aug. 1, 1988, now U.S. Pat. No. 4,915,033.

BACKGROUND AND SUMMARY OF THE INVENTION

My co-pending U.S. patent application Ser. No. 227,099 discloses a pallet for supporting a plurality of similarly shaped parts piled one above another in a stacked condition. The pallet comprises a rectangular base adapted to seat flatwise on a factory floor, and a plural number of upstanding locator pins extending upwardly from the base to form an enclosure for a stack of parts.

The base has a series of linear slots extending therealong to accommodate the lower ends of the locator pins. Anchorage devices are associated with the pins to hold them in selected positions of adjustment along the slots depending on the configuration of the parts to be stacked on the base. The use of continuous slots is advantageous in that an infinite number of pin adjustments can be realized, within limits dictated by the lengths of the individual slots.

The present invention is directed to a pallet construction that is basically the same as the pallet structure shown in U.S. patent application Ser. No. 227,099. One aim of the present invention is to provide a pallet that can be a relatively lightweight construction while at the same time being relatively strong and effective as an anchorage mechanism for the locator pins.

The presently proposed pallet structure comprises a base formed in part by two parallel tubes spaced to define a midplane for the base. These tubes have rectangular cross sections designed to receive therein the lifter arms (prongs) of a fork lift truck. This feature enables the pallet to be readily transported from one point in a factory to another, via conventional lift truck operations.

The base of the pallet further comprises structural beam elements extending transversely from end areas of the fork liftreceiving tubes, and other structural beam elements interconnecting the outer ends of the first mentioned beam elements, to define a base having a rectangular configurations (when view in the top plan direction). The base is relatively strong, yet relatively liqht in weight (in relation to its capacity for supporting stacked parts).

The slot mechanism for adjustably anchoring the upstanding locator pins comprises a plural number (e.g., eight) elongated channel members (or hollow tracks) oriented horizontally on the upper surfaces of the rectangular cross-sectioned tubes and connected beam elements These channels (tracks) have upwardlyfacing slots running therealong to receive lower end areas of the upstanding locator pins. The extreme lower ends of the pins are constructed as non-circular plug elements, adapted to detachably fit into socket cavities provided within block-like anchorage devices slidably disposed within the hollow tracks The anchorage devices can be moved back and forth along the tracks to adjust the positions of the upstanding locator pins.

Typically, each locator pin has a total length of about twenty-five inches. About four inches of the pin length are formed into a non-circular plug element. This relatively long length plug element has a fairly rigid wobble-free connection with the associated socket cavity in the subjacent anchorage device.

The individual hollow tracks (channels) are relatively light in weight, yet they have relatively thick vertical internal dimensions (e.g., about four inches) for accommodating relatively thick anchorage blocks, as necessary, to achieve a firm support for the upstanding locator pins.

A principal object of this invention is to provide a pallet construction that is relatively light in weight, while at the same time providing firm rigid connections between the base area of the pallet and the adjustable locator pins. In preferred practice of the invention, the base of the pallet includes two horizontal tubes designed to accommodate the lifter arms of a fork lift truck.

THE DRAWINGS

FIG. 1 is a perspective view of a pallet constructed according to the invention.

FIG. 2 a plan view of the FIG. 1 pallet, but with the locator pins having different adjusted positions (to accommodate differently stackable parts).

FIG. 3 is a side elevational view of the FIG. 1 pallet, with a second pallet adapted to be stacked on the lower pallet shown in phantom.

FIG. 4 a fragmentary view, partly in section, showing an anchorage mechanism for a representative locator pin used in the FIG. 1 pallet.

FIGS. 5 and 6 are sectional views taken on lines 5–5 and 6–6 in FIG. 4.

FIG. 7 is a side elevational view of a track structure and locator in FIG. 4.

FIG. 8 sectional view taken in the same direction as FIG. 4, but illustrating an alternative anchorage mechanism FIG. 9 is a sectional view taken on line 9–9 in FIG. 8.

DESCRIPTION OF A PREFERRED EMBODIMENT OF THE INVENTION

Figure 1:
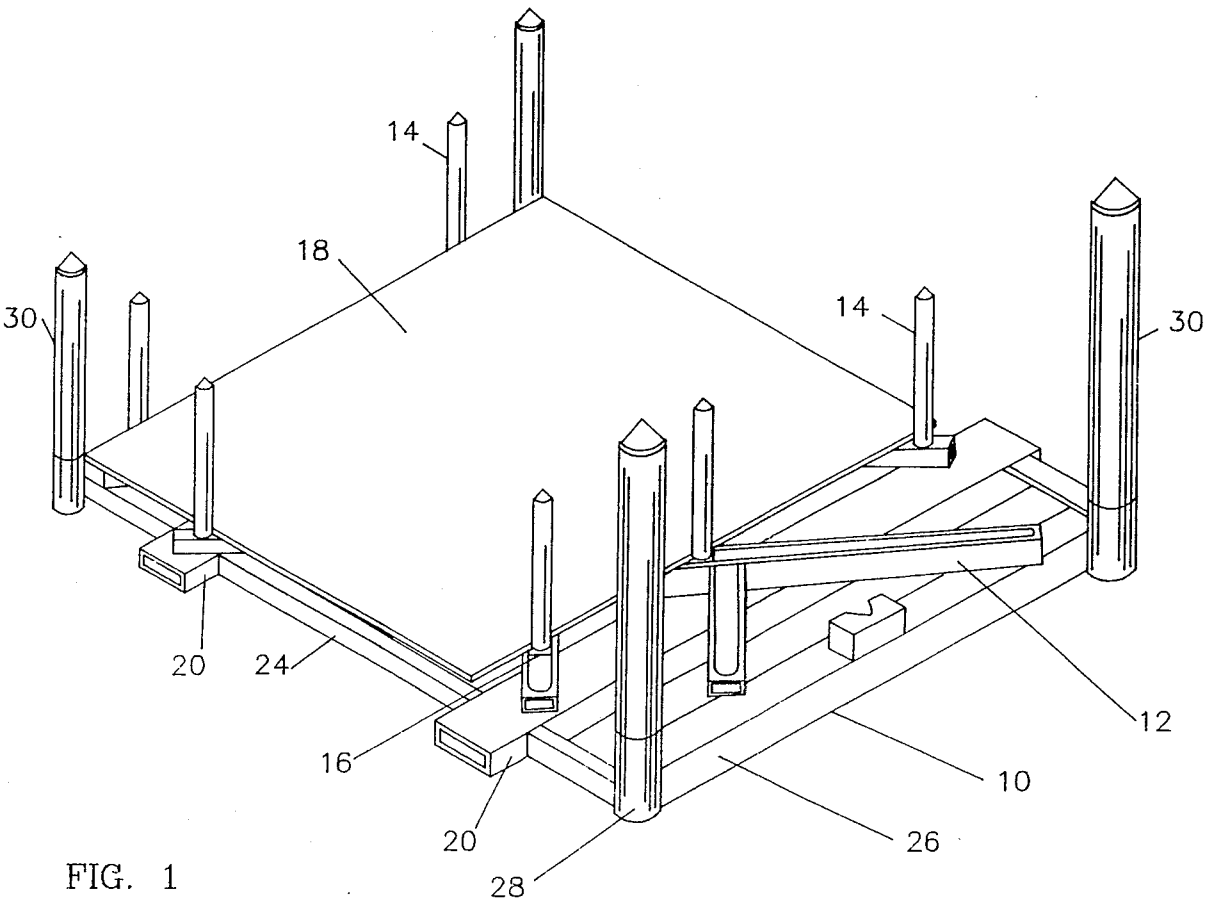
Figure 2:
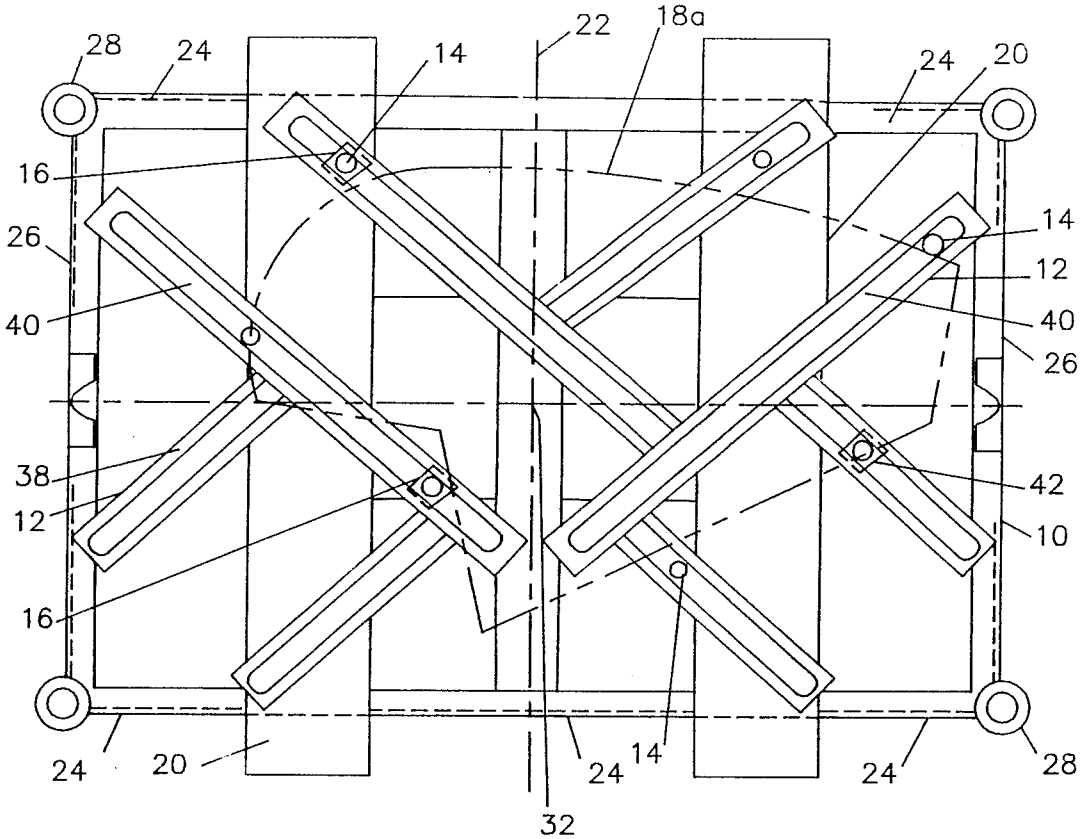
Figure 3:
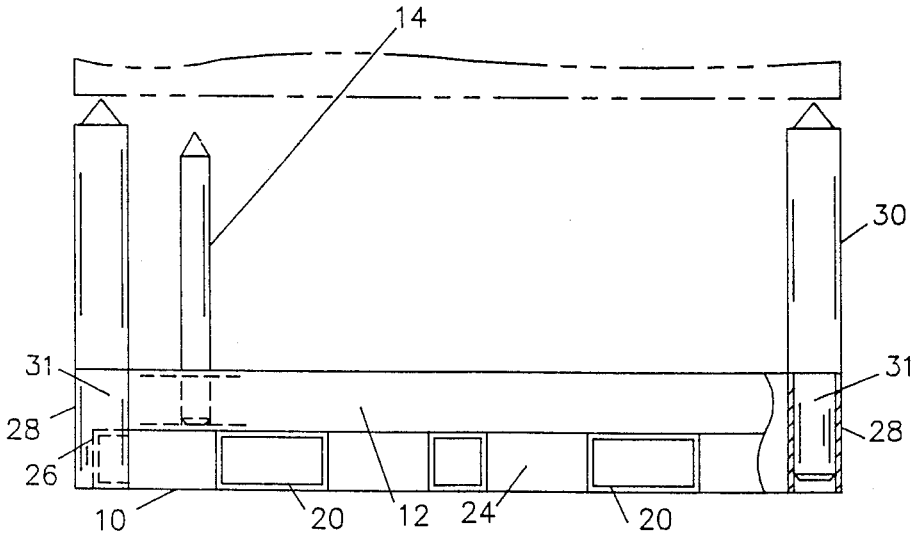
Figure 6:
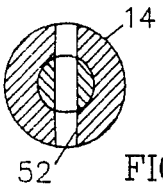

FIGS. 1 through 3 show a pallet structure embodying the invention. FIGS. 4 through 7 illustrate structural details used in the FIG. 1 pallet structure. The pallet structure comprises four basic components, namely a base 10, a plural number of horizontal tracks 12 affixed to said base, a number of upstanding locator pins 14, and pin anchorage mechanisms 16 slidably disposed in the various tracks. The pin anchorage mechanisms are individually constructed so that when a locator pin is inserted into an anchorage mechanism and turned around the pin axis, the anchorage mechanism exerts a clamping force on interior surfaces of the associated track 12, thereby retaining the associated locator pin in a fixed position of adjustment.

FIG. 1 shows six locator pins 14 positioned in tracks 12 along edge areas of a rectangular steel plate 18. Plate 18 constitutes a representative workpiece forming part of a stack of parts to be supported and oriented one above another on the pallet. In a typical factory installation, plates 18 will be deposited into the space circumscribed by the locator pins from an overhead point. The "depositing" process may be performed manually or by a mechanical means, depending on the nature of the part and the extent to which the factory might be automated. When a stack of parts is built up on the pallet, the pallet can be moved to a different work station, via a fork lift truck, not shown.

Locator pins 14 can take various different adjusted positions, depending on the configuration (shape) of the parts to be stacked 10 on the pallet. FIG. 2 shows the locator pins 14 adjusted for positionment along the border (edges) of an irregularly-shaped stack of parts 18*a*.

Base 10 of the pallet includes two parallel horizontal tubes 20 spaced to define an imaginary midplane (bisection point) 22 through the base. As shown in FIG. 3 each tube 20 has a rectangular cross-section, typically four inches by eight inches. The spacing between tubes 20 is such that the lifter prongs of a conventional lift truck not shown) can be moved into the tubes by driving the truck toward the pallet. With the prongs inserted into tubes 20, the pallet can be transported to a new location.

Transverse structural beam elements 24 extend between tubes 20 and also outwardly (laterally) from the tubes, as shown in FIG. 2, i.e., there are three such beam elements at each tube end area. Other structural beam elements 26 interconnect the free ends of the beam elements to form a generally rectangular base, as viewed in FIG. 2. The various tubes and beam elements are welded together to form a unitary rigid base structure. Each beam elements 24 or 26 is preferably a channel element.

The illustrated base includes short corner sleeves 28 at its corners. These sleeves serve as reception points for corner posts 30 (FIG. 3). Each corner post includes a plug section 31 telescope into a sleeve 28 to releasably mount the post on base 10. The pallet can be used with or without the corner posts. The primary purpose for the corner posts is to permit two or more pallets to be stacked one above another, as indicated schematically in FIG. 3. The upper end of each corner post can telescope into the corner sleeve of the superjacent pallet to stack the pallets one above the other.

As such in FIG. 2, there are eight horizontal tracks 12 affixed to the upper face of base 10, i.e. the upper surfaces of 15 tubes 20 and beam elements 26. The upper and lower surfaces of tubes 20 and the various beam elements are in common horizontal plans, such that their upper surfaces form suitable mounting surfaces for tracks 12. The tracks are rigidly welded to tubes 20 and beam elements 26. Additionally, the confronting ends of selected tracks may be welded together to further rigidify the track system.

The eight tracks shown in FIG. 2 are arranged in four pairs, with the tracks in each pair being parallel to one another. Each pair of tracks extends from a corner area of base 10 generally toward the central axis 32 of the base. The tracks are of different lengths, but they could be of the same length, if so desired.

Figure 4:
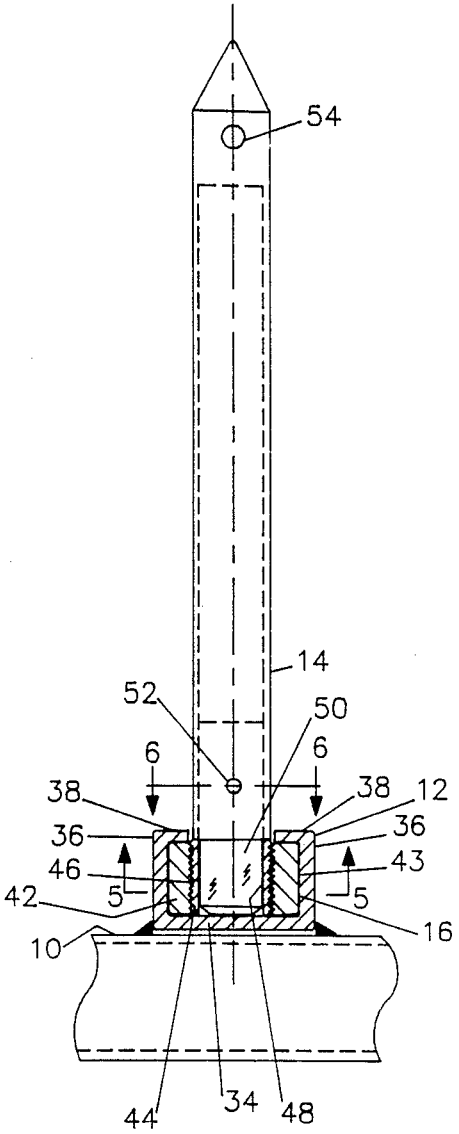
Figure 7:
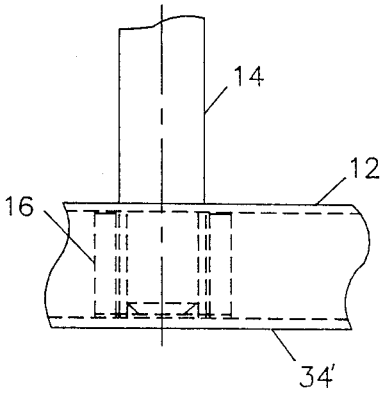

FIG. 4 illustrates a representative cross-section of one of the tracks 12. Each track has a similar C cross-section, comprising a horizontal bottom wall 34, two vertical side walls 36, and two inturned upper flanges 38. The space between the inner edges of flanges 38 forms an elongated slot 40 (FIG. 2). Each track is preferably formed from a square cross-sectioned steel tube. Slot 40 is milled out of one wall of the tube. As seen in FIG. 2, each slot 40 stops short of the outer "free" end of the associated track 12. This is to rigidify the tube end area against undesired spreading apart of the track side walls. The "inner" ends of the tracks do not require such rigidification because they are welded to an adjacent wall of an abutting track.

Figure 5:
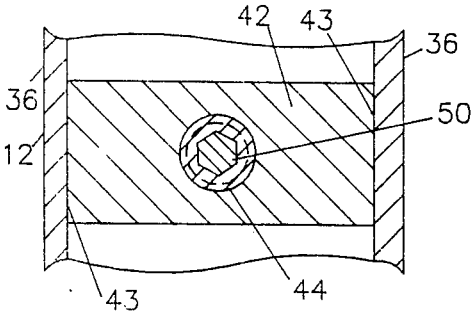

Each track is adapted to slidably receive one or more anchor blocks 42 (FIGS. 4 and 5). As seen in FIG. 5, anchor block 42 has a square cross section, with flat faces 43 of the block being slidably positioned on (against) the inner side surfaces of track walls 36. The block can slide along the track interior space, but it cannot rotate.

Block 42 has a vertical threaded hole extending entirely therethrough. A cooperating socket member 44 has an external threaded area 46 meshed with the threaded surface of the hole in block 42. The socket member has a sleeve-like character, such that a central hexagonal socket cavity 48 extends through the socket member Each locator pin 14 has its lower end configured as a hexagonal-shaped plug element 50 mated to socket cavity 48 in any one of members 44. Each locator pin is connected to its associated plug by a roll pin 52. FIG. 4 shows a representative locator pin 14 arranged so that its plug element 50 is fully extended into cavity 48 in the associated member 44. In this position, the locator pin can be turned around its vertical axis to apply a turning torque to member 44. As member 44 is turned in one direction, the thread interaction between members 44 and 42 causes member 42 to be shifted upwardly in track 12 so that the upper face 10 of member 42 exerts a clamping force against the undersurfaces of track flanges 38. In relative terms, member 44 exerts a downward force on track wall 34 while member 42 is pressuring flanges 38. This upward movement of member (block) 42 is relatively slight, only a few thousandths of an inch, is necessary to eliminate play between the block and track 12.

This manual turning motion of locator pin 14 is used after the locator pin is in its desired position of adjustment (as determined by a template or an actual part 18 or 18*a*). The turning motion of pin 14 locks block 42 in the desired adjusted position Pin 14 can be lifted out of the anchorage mechanism without disturbing the adjusted position of anchor block 42, e.g., should it be desired to temporarily stack different size parts (workpieces).

Through holes 54 are provided in the upper ends of pins 14 to receive a turning rod for achieving an increased turning force. It might on occasion be desired to clamp anchor block 42 more tightly to track 12 than can be achieved by manually turning pin FIGS. 4 and 5 represent the preferred mechanism for adjustably positioning and locking locator pins 14 at selected points along the associated tracks 12. It will be appreciated, however, that other locking mechanisms could be employed while still using the principal features of the invention, namely the illustrated base 10 and system of tracks 12.

Figure 8:
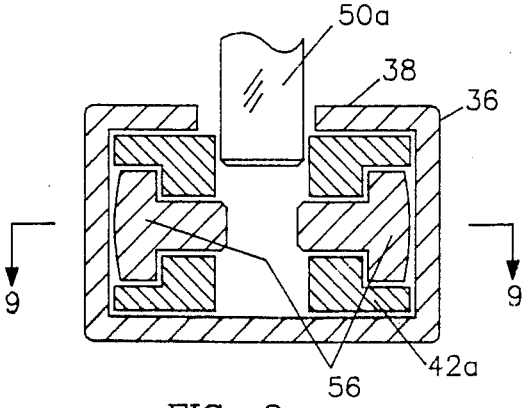
Figure 9:
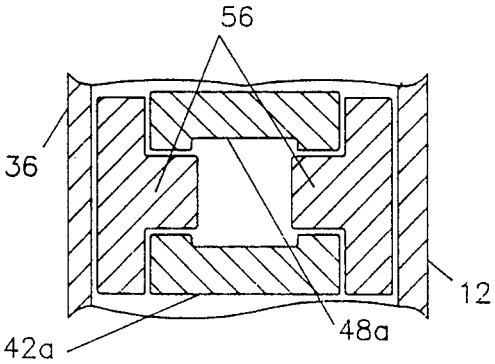

For purposes of indicating the potential breadth of application of the base 10-track 12 combination, there is shown in FIGS. 8 and 9 an alternate locking (anchoring) mechanism. A square anchor block 42*a* has a square cross-sectioned socket cavity 48*a* extending vertically therethrough. The cooperating plug element 50*a* on the lower end of the locator pin has a similar cross 15 section.

Two floating pads 56 are slidably positioned in block 42*a* for slight movement toward or away from track side walls 36. The inner ends of pads 56 project slightly into the socket space 48*a*. As the locator pin is moved downward, the side faces of plug element 50*a* cam against the inner ends of the pads to cause them to exert clamp forces on track walls 36. When the locator pin is removed (lifted), pads 56 release the clamp forces.

As previously noted, FIGS. 4 and 5 illustrate the preferred locking mechanism. The invention is concerned with the FIG. 4 locking mechanism and also with the construction used in making base 10 and tracks 12.

The track 12 construction is considered advantageous in that it can have a substantial vertical thickness, on the order of four inches. The full-length socket cavity 48 will then have a similar length, such as to provide substantial support for locator pins 14. With a plug element 50 length of four inches, the locator pin will be supported in a rigid, wobble-free fashion.

Base 10 and tracks 12 each have a relatively large vertical dimension (e.g., about four inches), such that the pallet has rigidity and substantial resistance against possible damage associated with the deposition (dropping) of heavy steel parts onto a stack of parts. The pallet can support a relatively large weight without buckling or breakage. At the same time, the pallet is not itself excessively heavy. The two fork lift prong-reception tubes 20 act as three-dimensional reinforcements for the pallet base. Tracks 12 also contribute some rigidity to the base.

The drawings necessarily show specific forms of the invention. It will be appreciated that the invention can be practiced in other forms.

I claim:

1. A pallet for supporting a plurality of similarly-shaped parts piled one above the other in a stacked position; said parts having a border with a common configuration; said pallet comprising:

a base that includes a plural number of hollow elongated horizontal tracks;

at least one non-rotary anchor block keyably and slidably arranged in each track for slidable adjustment therealong; each anchor block having a vertically extending threaded hole therein;

a socket member associated with each anchor block; each socket member having an external threaded area meshed with the hole threads, and a vertical straight-sided cavity centrally arranged within the external threaded area; and a plural number of elongated upstanding locator pins, each locator pin including a non-circular plug element adapted to have a non-rotary fit in any one of the socket member cavities, each of said locator pins being turnable to rotate the associated socket member, such that the associated anchor block is moved vertically upwardly to grip an internal surface of the associated track.

2. The pallet of claim 1, wherein each of said vertical cavities extends entirely through the associated socket member.

3. The pallet of claim 2, wherein each of said threaded holes extends entirely through the associated anchor block.

4. The pallet of claim 3, wherein each horizontal track as a C-shaped cross-section, that includes a horizontal bottom wall section, two vertical side wall sections, and two inturned upper flanges.

5. The pallet of claim 4, wherein the two inturned flanges define a slot extending substantially the entire length of the associated track.

6. A pallet for supporting a plurality of similarly-shaped parts piled one above the other in a stacked position; said parts having a border with a common configuration, said pallet comprising:

a base that includes two parallel horizontal tubes spaced to define a mid plane through the base, said tubes having rectangular cross-sections designed to receive therein the lift arms of a fork lift truck, whereby the base can be transported from one place to another; said base further including first structural beam elements extending transverse to said tubes near opposite ends thereof, and second structural beam elements connecting end areas of the first beam elements, to define a base having a rectangular configuration in the top plan view;

a plural number of elongated linear hollow tracks affixed to upper face areas of said base, each track extending at an acute angle to the aforementioned mid plane; each track comprising a separate hollow horizontal tubular element having a longitudinal slot in its upper surface;

an anchor means slidably positionable in each hollow track for adjusting movements therealong; each anchor means having a socket cavity registering with the elongated slot in the associated track;

elongated upstanding locator pins having noncircular plug elements adapted to fit into the socket cavities in the adjustable anchor means;

each anchor means having surface areas thereof adapted to exert clamp forces on the associated track when a locator pin is inserted into the associated socket cavity whereby the locator pin then automatically assumes a fixed location along the associated track.

7. The pallet of claim 6, wherein said tracks are affixed directly to upper face areas of the rectangular tubes and structural beam elements.

8. The pallet of claim 7, wherein said rectangular tubes and structural beam elements are in planar alignment: said rectangular tubes and structural beam elements having a common vertical thickness dimension so that their upper and lower faces are in common horizontal planes.

9. The pallet of claim 8, wherein said tracks have C cross-sections; each track cross-section including a horizontal bottom wall section, two vertical wall sections, and two inturned upper flanges.

10. The pallet of claim 9, wherein each track has a substantial vertical thickness approximating the vertical thickness of the subjacent base; the socket cavity in each anchor means extending the full vertical dimension of the anchor means, such that the locator pins have substantial axial plug element areas fittable into the cavities.

11. The pallet of claim 10, wherein each socket cavity is approximately four inches measured in the vertical direction.

12. The pallet of claim 6, wherein each anchor means comprises an anchor block having a square cross-section when taken along a horizontal plane through the block.

13. The pallet of claim 6, wherein there are eight individual tracks arranged in four pairs, each pair of tracks extending from a corner area of the base toward the central axis of the base; the tracks in each pair being in approximate parallelism with each other.

* * * * *